US005823697A

United States Patent [19]

Talbot

[11] Patent Number: 5,823,697

[45] Date of Patent: Oct. 20, 1998

[54] MARKING INSTRUMENT WITH SEALABLE DIAPHRAGM

[75] Inventor: John Mitchell Talbot, Gosport, United Kingdom

[73] Assignee: The Gillette Company, Boston, Mass.

[21] Appl. No.: 489,981

[22] Filed: Jun. 14, 1995

[30] Foreign Application Priority Data

Jan. 14, 1993 [GB] United Kingdom ..... 9300662

[51] Int. Cl.[6] ..... B43K 9/00

[52] U.S. Cl. ..... 401/108; 401/99

[58] Field of Search ..... 401/107, 108, 401/99, 154

[56] References Cited

U.S. PATENT DOCUMENTS

| | | | |
|---|---|---|---|
| 2,957,452 | 10/1960 | Brannon | 401/108 |
| 3,035,299 | 5/1962 | Gordon et al. | 401/107 |
| 3,945,734 | 3/1976 | Woodbridge | 401/108 X |

FOREIGN PATENT DOCUMENTS

| | | | |
|---|---|---|---|
| 0 150 557 | 8/1985 | European Pat. Off. . | |
| 1252736 | 12/1960 | France . | |
| 612 885 | 8/1979 | Germany . | |
| 417235 | 1/1947 | Italy | 401/154 |

*Primary Examiner*—Steven A. Bratile
*Attorney, Agent, or Firm*—Chester Cekala

[57] ABSTRACT

A marking instrument, e.g. a felt tip marker, has a retractable marking tip (4) carried by a marker unit (5) housed within the barrel, and a rolling diaphragm (10) connecting between the marker unit and barrel to form a sealed envelope around the tip (4) when the tip is retracted. Upon retraction of the tip the marker unit rotates to twist the diaphragm and close the envelope.

8 Claims, 2 Drawing Sheets

MARKING INSTRUMENT WITH SEALABLE DIAPHRAGM

This invention is concerned with marking instruments. In particular the invention relates to a marking instrument of the retractable kind, that is having a marking unit disposed within a barrel and movable relative thereto for adjusting a marking tip carried by the marking unit between an operative position projecting from the barrel, and a retracted position within the barrel. Such retractable marking instruments are very well known and have the advantage that the need for a separate cap for covering the writing tip during periods of non-use is obviated. They are quite satisfactory when the instrument is of a type, e.g. ball point pens, which do not suffer from problems of marking fluid drying up at the tip when the tip is left exposed to ambient conditions for extended periods of non-use and making subsequent re-starting of the marking operation difficult. For these applications where the marking tip is susceptible to drying-out, e.g. felt tip and fibre tip pens, special steps are needed to provide a sealed enclosure around the marking tip. Various solutions have been proposed, such as a perforated seal through which the marking tip may be pushed in moving from the retracted position to the operative position, and a hinged flap adapted to shut when the tip is retracted to close it off from the opening at the forward end of the barrel. A hinged flap mechanism is complicated and demands considerable space within the barrel. A perforated seal suffers the drawback that deposits of marking fluid can build up on the seal and possibly interfere with its operation as it is acted upon directly by the tip.

The present invention aims at an alternative solution which avoids the limitations of the prior art proposals, and according to the invention there is provided a retractable marking instrument comprising a flexible annular diaphragm sealingly connected between the marking unit and a surrounding tubular part relative to which the marking unit is movable axially and rotatably, whereby rotation of the marking unit relative to the tubular part causes the diaphragm to close an airtight enclosure around the retracted marking tip.

In an especially convenient construction the diaphragm is a rolling diaphragm having an inner portion received in a circumferential groove extending around the marking unit adjacent the tip, an outer portion held between two barrel parts, and an intermediate generally tubular rolling portion arranged to be twisted so that the diaphragm forms a sealed envelope around the retracted tip.

A better understanding of the invention will be gained from the following detailed description of an embodiment, reference being made to the accompanying drawings wherein.

Figure 1:
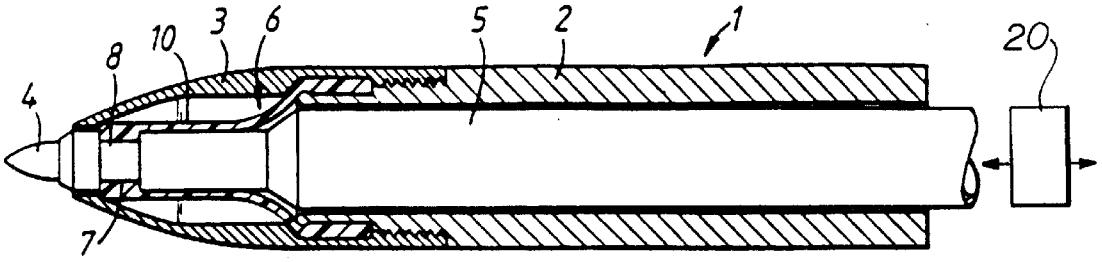
FIG. 1 is a schematic axial cross-section through the forward end portion of a marking instrument, such as a felt tip highlighting marker, in accordance with the invention, the tip being in its projected operative position.
Figure 3:
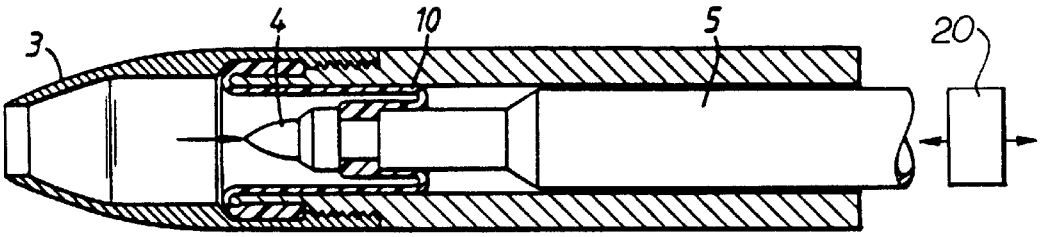

The felt tip marker illustrated in the drawing includes a barrel 1 having a cylindrical part 2 and a tapered nose part 3 defining the forward end of the barrel and including a central hole for passage of the marker tip 4. As shown the two barrel parts 2, 3 are connected by a screw thread. Within the barrel is housed a marker unit 5 which includes a reservoir for the marking fluid and which carries the marker tip 4 at its front end. The marking unit 5 is movable within the barrel 1 for displacing the tip between the operative and retracted positions as illustrated in FIGS. 1 and 3 respectively. A retraction mechanism 20 will be provided between the barrel and marking unit for effecting the relative movement between them. The construction of the retraction mechanism 20 itself forms no part of the present invention and any suitable form of mechanism 20 may be used.

Figure 2:
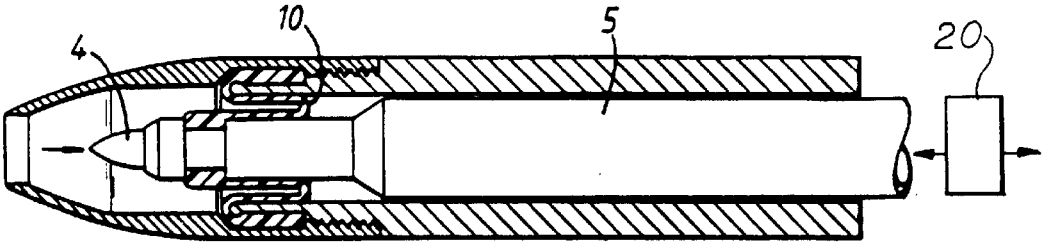
FIGS. 2 and 3 show the marker of FIG. 1 at intermediate stages during movement of the tip between its operative and retracted positions.
Figure 4:
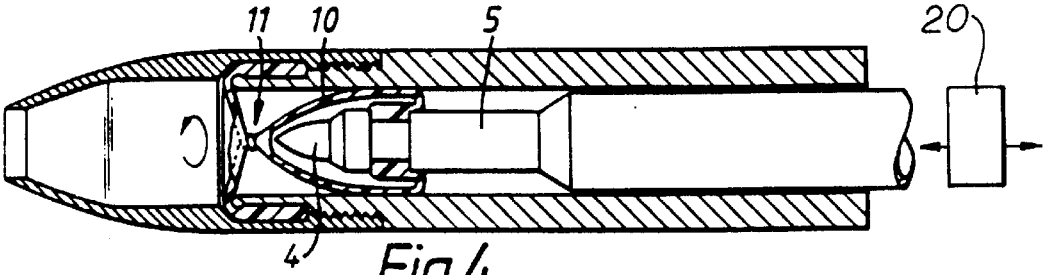
FIG. 4 shows the marker of FIG. 1 with the tip adjusted to its fully retracted position.

Connected between the barrel 1 and the marking unit 5 is a flexible rolling diaphragm 6 of elastomeric material. An inner edge of the diaphragm has a cylindrical collar 7 which is sealingly engaged in a circumferential groove 8 provided in the forward end portion of the marking unit at a small distance from the tip 4. A cylindrical portion 9 at the outer edge of the diaphragm is held firmly between the two barrel parts 2, 3. The intermediate portion 10 of the diaphragm between the inner and outer edge portions 7, 9 is arranged to roll within itself, as illustrated in FIGS. 2 and 3, as the marking unit is withdrawn axially for reacting the tip 4 from its operative position, and when the tip is fully retracted this intermediate portion defines a tubular sleeve surrounding the tip 4. Rotation of the marking unit with respect to the barrel 1 causes this sleeve to become twisted, as indicated at 11 in FIG. 4, thereby sealing the forward end of the sleeve which forms an envelope completely enclosing the tip 4 and isolating the tip from ambient atmosphere so that marking fluid will not be lost through evaporation and the tip will not dry out. When the marker is to be used, the marking unit is rotated in the reverse direction to untwist the diaphragm sleeve and the marking unit is advanced along the barrel to move the tip to the operative position.

The rotation of the marking unit to twist and untwist the sleeve, may be effected immediately after moving the tip to the retracted position and immediately before advancing the tip from the retracted position, respectively. Alternatively, the retraction mechanism may be so arranged that the marker unit undergoes a helical movement so that the rotation is performed simultaneously with longitudinal displacement of marking unit.

Figure 5:
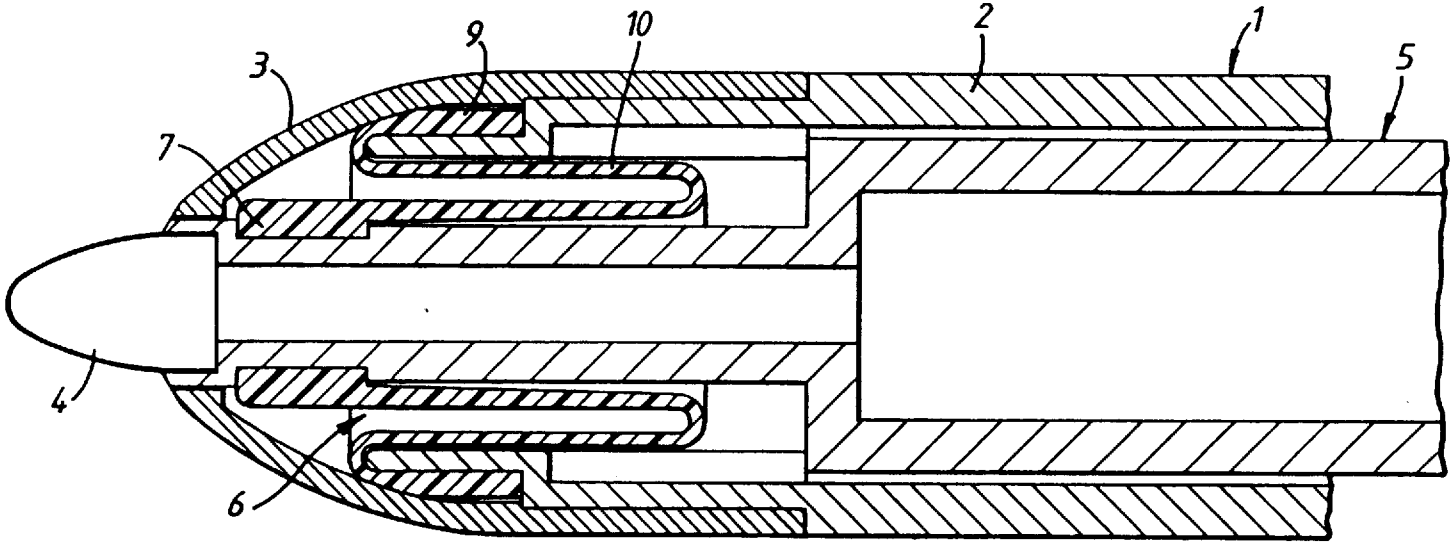
FIG. 5 is an axial section through a modified embodiment.

The modified marker of FIG. 5 is essentially the same as that of FIGS. 1–4 and the same references have been used to denote corresponding elements in the respective embodiments. The main difference is that the outer edge of the diaphragm is clamped at a position nearer the end of the barrel so that, when the tip is in its operative position a rolled intermediate diaphragm portion exists, this portion extending rearwardly from the inner collar 7 and then forwardly again. In this way the correct rolling action of the diaphragm is reliably ensured, and reduced axial displacement is necessary between the operative and retracted tip positions. In other respects the construction and operation of the diaphragm are as described above.

It will be appreciated that other modifications are also possible without departing from the inventive concept. For example, it is not essential that the marking unit 5 is movable and as an alternative the outer edge of the diaphragm could be secured to a part of the barrel which is selectively movable to expose or enclose the tip and to control the diaphragm for forming the envelope to surrounds the tip.

I claim:

1. A retractable marking instrument comprising:

a barrel having a marker unit with a marking tip disposed therein, said marker unit being movable longitudinally relative to a surrounding part of said barrel for displacement of said marking tip between operative and retracted positions; and a flexible annular diaphragm having the inner edge thereof sealingly connected to said marking unit and the outer edge sealingly connected to said barrel surrounding part, said marking unit and said barrel surrounding part being rotatable relative to one another to cause said diaphragm to form a sealed enclosure around said tip in the retracted position.

2. A retractable marking instrument according to claim 1 wherein said diaphragm is a rolling diaphragm arranged to define a sleeve surrounding said writing tip and to form said sleeve into a sealed envelope enclosing said tip in response to relative rotation of said marking unit and said surrounding part.

3. A retractable marking instrument according to claim 2 wherein said diaphragm has an inner edge portion in direct sealing engagement with said marking unit adjacent to said marking tip.

4. A retractable marking instrument according to claim 3 wherein said diaphragm has a collar engaged in a circumferential groove in said marking unit.

5. A retractable marking instrument according to claim 3 wherein said barrel is formed of a pair of connected parts and wherein said diaphragm has its outer edge portion held between said two barrel parts.

6. A retractable marking instrument according to claim 5 wherein said outer edge portion is substantially cylindrical and is positioned radially between said barrel parts.

7. A retractable marking instrument according to claim 6 wherein a retraction mechanism is provided for effecting longitudinal and rotational movement of said marking unit with respect to said barrel of said instrument.

8. A retractable marking instrument according to claim 7 wherein said retraction mechanism causes said marking unit to undergo helical movement in said barrel during advancement and retraction of said marking tip.

* * * * *